US005582754A

United States Patent [19]

Smith et al.

[11] Patent Number: 5,582,754

[45] Date of Patent: Dec. 10, 1996

[54] HEATED TRAY

[75] Inventors: Kevin W. Smith; Terry L. Hygema, both of North Webster, Indiana.

[73] Assignee: Heaters Engineering, Inc., North Webster, Indiana.

[21] Appl. No.: 374,895

[22] Filed: Jan. 19, 1995

Related U.S. Application Data

[63] Continuation-in-part of Ser. No. 163,928, Dec. 8, 1993.

[51] Int. Cl.[6] ..... H05B 3/06; F25C 5/08

[52] U.S. Cl. ..... 219/438; 219/386; 219/521; 62/351

[58] Field of Search ..... 219/385–387, 219/436–438, 521, 549; 62/351; 249/78

[56] References Cited

U.S. PATENT DOCUMENTS

| | | | |
|---|---|---|---|
| 1,852,064 | 4/1932 | Rosenberg . | |
| 1,977,608 | 10/1934 | Blystone . | |
| 2,069,567 | 2/1937 | White . | |
| 2,112,263 | 3/1938 | Bohannon et al. . | |
| 2,115,944 | 5/1938 | De Witt . | |
| 2,941,377 | 6/1960 | Nelson . | |
| 2,941,378 | 6/1960 | Nelson . | |
| 3,020,730 | 2/1962 | Harris, Sr. . | |
| 3,283,284 | 11/1966 | Eisler . | |
| 3,318,105 | 5/1967 | Burroughs et al. . | |
| 3,544,762 | 12/1970 | Eisler . | |
| 3,720,807 | 3/1973 | Ting . | |
| 3,745,290 | 7/1973 | Harnden, Jr. et al. . | |
| 3,775,992 | 12/1973 | Bright . | |
| 3,784,787 | 1/1974 | Shevlin . | |
| 3,869,596 | 3/1975 | Howie . | |
| 3,952,539 | 4/1976 | Hanson et al. . | |
| 4,063,068 | 12/1977 | Johnson et al. . | |
| 4,134,004 | 1/1979 | Anderson et al. . | |
| 4,388,607 | 6/1983 | Toy et al. | 219/549 |
| 4,400,614 | 8/1983 | Sopory | 219/549 |
| 4,543,474 | 9/1985 | Horsma et al. | 219/553 |
| 4,668,857 | 5/1987 | Smuckler | 219/549 |
| 4,701,597 | 10/1987 | Braun et al. . | |
| 4,710,612 | 12/1987 | Lin et al. | 219/549 |
| 4,756,165 | 7/1988 | Chestnut et al. . | |
| 4,921,648 | 5/1990 | Soni et al. | 264/27 |
| 4,933,534 | 6/1990 | Cunningham et al. . | |
| 4,959,528 | 9/1990 | Malloy | 219/436 |
| 5,111,025 | 5/1992 | Barma et al. | 219/549 |
| 5,286,952 | 2/1994 | McMills et al. | 219/549 |
| 5,382,384 | 1/1995 | Baigrie et al. | 252/11 |

FOREIGN PATENT DOCUMENTS

| | | |
|---|---|---|
| 3635286 | 4/1988 | Germany . |
| 2252285 | 8/1992 | United Kingdom . |

*Primary Examiner*—Teresa J. Walberg
*Assistant Examiner*—J. Pelham
*Attorney, Agent, or Firm*—Barnes & Thornburg

[57] ABSTRACT

A heated tray which can be activated to release a frozen liquid from compartments thereof. The tray includes an electrically insulative body having one or more compartments for receiving a liquid to be frozen. The tray also includes an electrically conductive polymer which can be heated by applying a potential across the conductive polymer. The conductive polymer is provided so as to be adjacent each compartment of the insulative body. The tray further includes first and second electrode grids on either side of the conductive polymer, which electrode grids include electrode members that are adjacent each compartment of the insulative body. The first and second electrode grids and the conductive polymer form a circuit which is used to heat the compartments of the insulative body.

34 Claims, 5 Drawing Sheets

| TIME IN MINUTES | TEMPERATURE IN DEGREES FAHRENHEIT | CURRENT IN AMPS | POWER IN WATTS | RESISTANCE IN OHMS |
|---|---|---|---|---|
| 0.5 | 3.4 | 1.33 | 93.1 | 52.6 |
| 1.0 | 7.0 | 1.25 | 87.5 | 56.0 |
| 1.5 | 14.0 | 1.13 | 79.1 | 61.9 |
| 2.0 | 22.9 | 1.07 | 74.9 | 65.4 |
| 2.5 | 30.8 | 1.02 | 71.4 | 68.6 |
| 3.0 | 38.1 | 0.98 | 68.6 | 71.4 |
| 3.5 | 44.9 | 0.96 | 67.2 | 72.9 |
| 4.0 | 50.9 | 0.93 | 65.1 | 75.3 |
| 4.5 | 56.4 | 0.91 | 63.7 | 76.9 |
| 5.0 | 61.8 | 0.91 | 63.7 | 76.9 |
| 5.5 | 66.2 | 0.89 | 62.3 | 78.7 |
| 6.0 | 71.0 | 0.87 | 60.9 | 80.5 |
| 6.5 | 75.0 | 0.86 | 60.2 | 81.4 |
| 7.0 | 78.4 | 0.85 | 59.5 | 82.4 |
| 7.5 | 81.6 | 0.84 | 58.8 | 83.3 |
| 8.0 | 84.7 | 0.83 | 58.1 | 84.3 |
| 8.5 | 87.6 | 0.82 | 57.4 | 85.4 |
| 9.0 | 90.5 | 0.81 | 56.7 | 86.4 |
| 9.5 | 93.0 | 0.81 | 56.7 | 86.4 |
| 10.0 | 95.5 | 0.80 | 56.0 | 87.5 |

FIG. 7

HEATED TRAY

BACKGROUND AND SUMMARY OF THE INVENTION

This is a continuation-in-part application of U.S. application Ser. No. 08/163,928, filed Dec. 8, 1993, for a "Heated Tray."

The present invention relates to a heated tray having one or more compartments formed therein that are designed to receive a predetermined quantity of liquid to be frozen. More particularly, the present invention relates to a heated tray that utilizes a conductive polymer material that includes either a polymer having a positive temperature coefficient or a thermoplastic to melt a portion of the frozen liquid adjacent the interface between the frozen liquid and the one or more compartments to aid in the removal of the frozen liquid therefrom.

Heated trays are known. One type of such tray includes a body formed to include a plurality of compartments that receive a predetermined quantity of liquid to be frozen. Once the liquid is frozen, at least a portion of the compartments are heated so as to melt the frozen liquid adjacent that heated portion of the compartment to aid in the removal of the frozen liquid therefrom. Electrical heating elements made from cylindrically-shaped coils or wires are typically employed to heat the compartments. Heating is accomplished by placing the coils or wires in close proximity to the compartments and applying a regulated electrical current thereto for a sufficient period of time in order to achieve a sufficient melting. Utilization of coils or wires frequently results in inefficient heating of the compartments and melting of the frozen liquid therein because the energy from such elements is often concentrated in localized areas. As a consequence, only portions of the frozen liquid adjacent the heated compartment are melted.

A thermostat is also employed with coils or wires to regulate the supply of electrical current thereto in order to control the heating thereof. The temperature of the coils or wires cycles between two extremes, an upper extreme at which the thermostat opens and a lower extreme at which the thermostat closes. This results in at least an undershoot and also a possible overshoot of any ideal temperature selected as especially suited for melting the interface between the frozen liquid and the compartments. Such undershoot and overshoot may be exacerbated over the life of the thermostat by structural fatigue and mechanical wear. Such fatigue and wear may contribute to or enhance undershoot and overshoot of the ideal temperature. In addition, use of a thermostat adds costs to the design and repair of heated trays.

Heated trays have found application in automatic ice makers. Such ice makers include a control unit that has motor driven ejector blades for facilitating the removal of the frozen liquid from the compartments subsequent to heating. Use of ejector blades requires that the compartments have at least one ramped or inclined edge so that the frozen liquid therein can be scooped out. The need for an angled edge results in most heated trays for automatic ice makers having a crescent or semi-circular compartmental cross-sectional shape. Other aesthetically pleasing shapes such as cubically-shaped compartments are generally unavailable.

There are also functional disadvantages associated with the use of crescent-shaped frozen liquid. Crescent-shaped frozen liquid is difficult to process and manipulate through items such as shoots used in refrigerators that provide ice through the door. This shape has been found to jam in these shoots. Additionally, the crescent-shape is difficult to handle because it tends to slide out from between a thumb and one or more fingers. Other shapes, such as a cube, have been found to alleviate these functional disadvantages.

A heated tray that solved some or all of the above-described problems associated with current trays that utilize thermostatically controlled coils or wires would be a welcome improvement. In addition, provision of cross-sectional shapes other than crescents and semi-circles for frozen liquid produced by automatic ice makers would be a welcome improvement.

Accordingly, one embodiment of the heated tray of the present invention includes a body having at least one compartment for receiving a liquid to be frozen. The compartment is configured to include a cavity. A conductive polymer material is disposed within at least a portion of the cavity so as to dimensionally conform therewith and at least two physically isolated electrodes are disposed within the cavity and electrically connected to the conductive polymer material so as to form an electrically continuous circuit therewith. The electrodes may be electrically connected to the conductive polymer material so as to ensure a generally uniform current flow density through the material. The electrodes may be located on opposite sides of the conductive polymer material. One of the electrodes may include a generally rectangular-shaped portion and the other of the electrodes may include a generally X-shaped portion.

The body may include a plurality of compartments each of which is configured to include a cavity. Each of the cavities has a conductive polymer material disposed within at least a portion thereof so as to dimensionally conform therewith. At least two electrodes are electrically connected to the conductive polymer material disposed in each of the cavities.

The electrodes of this embodiment may be formed from either stamping, printing, or wireform. The body may be formed from a variety of polymers such as polycarbonate, polyphenylene sulfide, or polyethylene sulfide. The conductive polymer material may be a polymer having a positive temperature coefficient or a thermoplastic. The conductive polymer may be composed of a high-density polyethylene based polymer to which carbon black is added in an amount equal to about 50% of the weight of the high-density polyethylene based polymer.

The body and the conductive polymer material may be flexible so as to aid in the removal of frozen liquid from the compartment or compartments. The tray may be formed by progressive insert molding and the compartments thereof may be generally crescent or semi-circularly shaped in cross-section. In addition, the compartments may be generally cubic in shape.

Another embodiment of the heated tray of the present invention includes a tray having at least one compartment formed therein for receiving a liquid to be frozen. The tray includes a conductive polymer material and an insulating plastic surrounding the conductive polymer material so as to generally conform to the shape and dimensions thereof. Structure is disposed between the conductive polymer material and the insulative plastic for generally evenly heating the conductive polymer material so as to melt an interface between the frozen liquid and the insulating plastic. The conductive polymer material may comprise a polymer having positive temperature coefficient or a thermoplastic. The conductive polymer may be composed of a high-density polyethylene based polymer to which carbon black is added in an amount equal to about 50% of the weight of the high-density polyethylene based polymer. The heating structure may comprise at least two electrically isolated electrodes in physical contact with the conductive polymer material so as to substantially evenly heat the conductive polymer material. The tray may include a plurality of compartments with two electrically isolated electrodes in physical contact with the conductive polymer material for each of the compartments. These electrodes may be formed from either stamping, printing, or wireform.

The conductive polymer material and insulative plastic may be flexible to aid in the removal of frozen liquid from the at least one compartment.

Yet another embodiment of the heated tray of the present invention includes an electrically insulative first tray portion having at least one compartment therein for receiving a liquid to be frozen. At least one electrode is disposed adjacent the compartment of the first tray portion. A second tray portion is formed from conductive polymer material and configured to have a corresponding number of compartments as the first tray portion. The second tray portion is also configured to generally conform in dimensions and shape to the first tray portion. At least one electrode is disposed adjacent the compartment of the second tray portion. An electrically insulative third tray portion is configured to have a corresponding number of compartments as the first tray portion. The third tray portion is also configured to generally conform in dimensions and shape to the first tray portion. In this embodiment of the heated tray of the present invention, the second tray portion is disposed between the first and third tray portions so as to be intermediate therewith and the first, second, and third tray portions are joined together so as to form the heated tray.

The first and third tray portions of the heated tray of this embodiment of the present invention may be formed from a variety of polymers such as polycarbonate, polyphenylene sulfide, or polyethylene sulfide. The conductive polymer may be formed from a polymer having a positive temperature coefficient or a thermoplastic. The conductive polymer may be composed of a high-density polyethylene based polymer to which carbon black is added in an amount equal to about 50% of the weight of the high-density polyethylene based polymer. The first, second, and third tray portions may be joined together by progressive insert molding.

The present invention may find application in an ice maker that includes the tray having at least one compartment configured to receive a predetermined quantity of water. The tray may be formed from conductive polymer material and an insulating material. The ice maker further includes structure for filling the compartment of the tray with water and structure for freezing the water in the compartment of the tray whereby ice is formed in the compartment. The ice maker further includes structure for applying an electric current to predetermined portions of the conductive polymer material of the tray so that the tray is generally evenly heated to loosen the ice. Finally, the ice maker includes structure for removing the ice from the compartment of the tray.

The conductive polymer material of the tray utilized in the ice maker may include a polymer having a positive temperature coefficient or, alternatively, a thermoplastic. The conductive polymer may be composed of a high-density polyethylene based polymer to which carbon black is added in an amount equal to about 50% of the weight of the high-density polyethylene based polymer. The electric current applying structure may include two electrodes which are located in the tray in electrical contact with the conductive polymer material so as to form a circuit therewith. The insulating material may encase the electrodes and the conductive polymer material. The electrodes may be located on opposite sides of the conductive polymer material.

The compartment of the tray utilized in conjunction with the automatic ice maker may be either generally crescent or semi-circular in cross-section and the removing structure may be a mechanism which scoops the ice out of the compartment.

The conductive and insulative material utilized in the tray of the automatic ice maker may be flexible so that the tray can be flexed to distort the shape of the compartment to facilitate the removal of ice therefrom. The tray utilized in connection with the automatic ice maker may be formed by either insert molding or a vacuum forming process.

The present invention also includes a method of using a conductive polymer material in a heated tray. The method includes the steps of forming a first tray portion from an electrically insulative material such that the tray has at least one compartment therein for receiving a liquid to be frozen. An electrode is placed adjacent the compartment of the first tray portion. A second tray portion is formed from a polymer having positive temperature coefficient or a thermoplastic such that the second tray portion has a corresponding number of compartments as the first tray portion and generally conforms in dimensions and shape to the first tray portion. The conductive polymer of the second tray may be formed by adding carbon black to a high-density polyethylene based polymer in an amount equal to about 50% of the weight of the high-density polyethylene based polymer. At least one electrode is placed adjacent the compartment of the second tray portion. A third tray portion is formed from an electrically insulative material such that the third tray portion has a corresponding number of compartments as the first tray portion and generally conforms in dimensions and shape to the first tray portion. The first, second, and third tray portions are joined together so as to form the heated tray.

The steps of forming the first, second, and third tray portions may include progressive insert molding or injection molding. The first, second, and third tray portions may be joined together by heatstaking or ultrasonic welding.

Other objects, advantages and novel features of the present invention will become apparent from the following detailed description of the invention when considered in conjunction with the accompanying drawings.

BRIEF DESCRIPTION OF THE DRAWINGS

FIG. 7 is a chart of test results for a heated ice cube tray of the present invention.

DETAILED DESCRIPTION OF THE DRAWINGS

Figure 1:
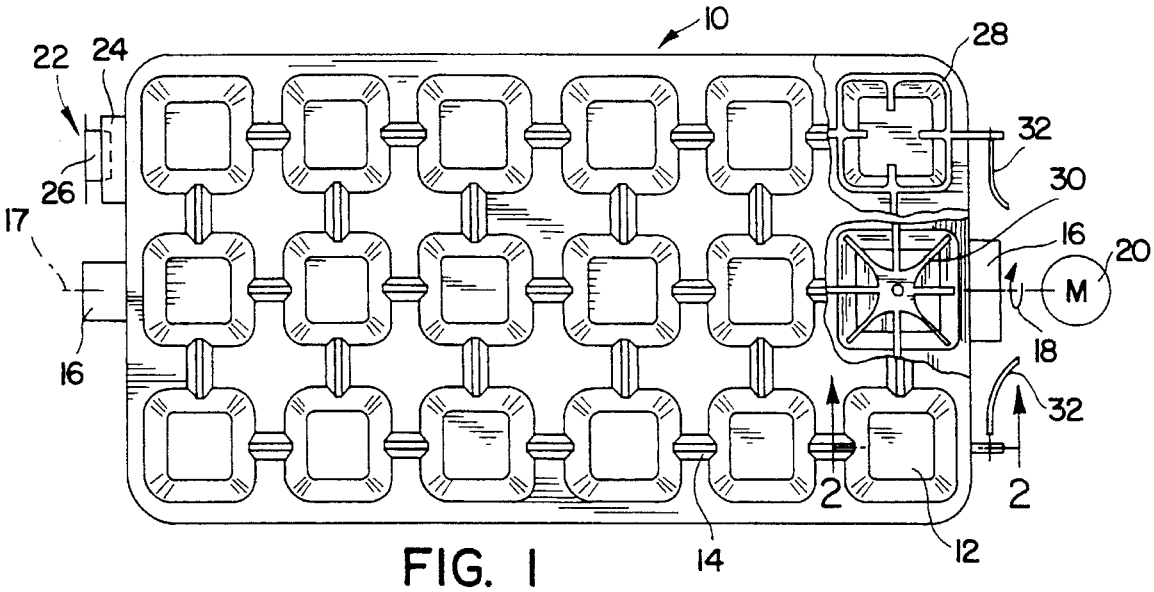
FIG. 1 shows a top view of a flexible heated ice cube tray of the present invention.

FIG. 1 shows a top view of a flexible heated tray 10 of the present invention. Tray 10 includes a plurality of bays or compartments 12 designed to receive a predetermined quantity of liquid, such as water, to be frozen. Tray 10 has a plurality of liquid distribution channels 14 formed therein that allow the liquid to flow between compartments 12 to facilitate the even filling thereof. Tray 10 may be mounted within an ice maker (not shown) via connectors 16 which are fixably secured thereto. Connectors 16 allow tray 10 to be rotated about an axis generally indicated by line 17 in the direction generally indicated by arrow 18. A motor 20, indicated in schematic by a circle and M, is used to provide such rotation.

A stop mechanism 22 of the ice maker facilitates the removal of the frozen liquid from compartments 12. Tray 10 includes a tab 24 formed thereon for cooperating with stop mechanism 22 in a manner discussed below. Stop mechanism 22 includes a tongue 26 that engages tab 24 during rotation of tray 10 in the direction generally indicated by arrow 18 via motor 20. The engagement of tab 24 and tongue 26 allows tray 10 to flex so as to break the interface between the frozen liquid and compartments 12. Once the interface is broken, the frozen liquid ejects from compartments 12 via the influence of gravity.

An electrode 28 and electrode 30 are generally illustrated in FIG. 1 in two of the plurality of compartments 12 of tray 10. Electrodes 28 and 30 are electrically connected to wires 32 and arranged so that electrode 28 lies above electrode 30. Wires 32 supply current to electrodes 28 and 30 which are in heat conducting relation with compartments 12 of tray 10 so as to aid in the removal of frozen liquid therefrom as discussed more fully below. Although only a single electrode 28 and electrode 30 are shown in FIG. 1, it is to be understood that each of compartments 12 includes a electrode 28 and a electrode 30. That is, grids of electrodes 28 and 30 are disposed in cavities adjacent compartments 12 of tray 10 as discussed more fully below. These grids are electrically connected together as will be discussed below in connection with FIGS. 3 and 4.

Although tray 10 in FIG. 1 is shown as being adapted so as to be installed in an ice maker, it is to be understood that flexible tray 10 may also be used without an ice maker such that frozen liquid in compartments 12 could be dislodged by manual flexing. If tray 10 is not used in an ice maker, components thereof such as connectors 16 and engagement tab 24 are unnecessary.

Figure 2:
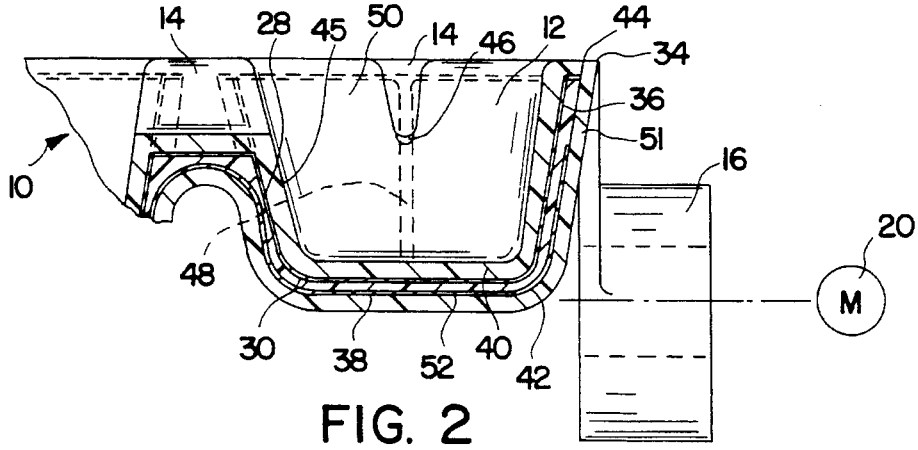
FIG. 2 shows a cross-section taken through FIG. 1 along line 2—2 thereof.

FIG. 2 shows a cross-sectional view through a compartment 12 of tray 10 taken along line 2—2 of FIG. 1. Tray 10 includes a body portion 34 that encases a conductive polymer 36 as well as top and bottom electrodes 28 and 30. As can be seen from FIG. 2, conductive polymer 36 is disposed in cavity 38 of body portion 34 such that it generally conforms to the shape and dimensions thereof. As can also be seen from FIG. 2, body 34 is formed from a first portion 40 and a second portion 42 that are connected together at a joint 44. Portions 40 and 42 can be connected together via such methods as heat staking or ultrasonic welding. In addition, tray 10 can be formed via a progressive insert molding process.

Body portion 34 of tray 10 is formed from an electrically insulative material and conductive polymer 36 is formed from an electrically conductive material. Possible materials for body 34 include a variety of polymers such as polycarbonate, polyphenylene sulfide, or polyethylene sulfide. Conductive polymer 36 may be formed from a polymer having a positive temperature coefficient or, alternatively, a thermoplastic. The conductive polymer may be composed of a high-density polyethylene based polymer to which carbon black is added in an amount equal to about 50% of the weight of the high-density polyethylene based polymer.

In operation, electrodes 28 and 30 carry current to and from conductive polymer 36. This causes conductive polymer 36 to reach a predetermined temperature so that an interface portion 45 of compartment 12 melts an adjacent portion of the frozen liquid therein. This makes removal of frozen liquid from compartment 12 easier. In addition, as discussed above, subsequent to melting, tray 10 can be flexed such that the shape thereof is distorted to further facilitate removal of the frozen liquid from compartments 12.

Use of conductive polymer 36 has several advantages over conventional heating via thermostatically controlled coils or wires. When a polymer having a positive temperature coefficient is used, the resistance of conductive polymer 36 rises with temperature such that the heat generated by the material does not substantially increase beyond a maximum predetermined temperature once conductive polymer 36 reaches a high resistive state. This makes the temperature of conductive polymer 36 easier to control than conventional coils or wires because a thermostat is generally unnecessary. Rather, only a predetermined quantity of current is necessary in order to generate a desired heat energy output. Elimination of a thermostat has the advantage of reducing the number of components necessary to construct a heated ice cube tray.

In addition, mechanical breakdown caused by structural fatigue of the bimetal contacts of the thermostat does not occur. Elimination of a thermostat and its associated breakdown thus reduces the overall costs of constructing and repairing a heated ice cube tray as well as non-operational downtime. Furthermore, overshoot and undershoot associated with thermostatically controlled heating devices are eliminated.

Use of conductive polymer 36 has the additional advantage of direct, immediate, and uniform heating of all surfaces in which it comes into contact unlike conventional coils or wires. A further advantage of the use of a conductive polymer 36 is that it is more energy efficient than heating via conventional coils or wires. Experiments have shown that a heated ice cube tray with a polymer having a positive temperature coefficient consumes only 50 watts of power whereas a conventional heated ice cube tray utilizing coils or wires consumes 190 watts or almost four times as much power. This makes the heated ice cube tray of the present invention less expensive to operate.

As can be seen from FIG. 2, compartment 12 has a generally cubic shape. Compartments 12 of the heated tray 10 of the present invention can be formed so as to provide a wide variety of additional aesthetically pleasing and functionally improved geometric shapes other than conventional crescent or semi-circular cross-sectional shapes used in automatic ice machines. As discussed above, crescent or semi-circular cross-sectional shape associated with frozen liquid formed from conventional ice makers results from the necessity for the use of one or more ejector blades to mechanically remove the frozen liquid from the tray compartments. Ejector blades require a ramped surface formed in compartments of the tray in order to facilitate removal of frozen liquid therefrom.

As can further be seen from FIG. 2, liquid distribution channels 14 are generally U-shaped in cross-section. As discussed above in connection with FIG. 1, liquid distribution channels 14 facilitate the uniform and even filling of compartments 12 with a liquid to be frozen. Electrodes 28 and 30 are shown as being disposed on opposite sides of conductive polymer 36. Electrodes 28 and 30 and conductive polymer 36 form an electrically continuous circuit with conductive polymer 36 which acts as a resistor disposed between these electrodes. As current flows through electrodes 28 and 30, conductive polymer 36 is heated, as discussed above, to a predetermined temperature. Electrodes 28 and 30 can be configured and positioned to facilitate a generally uniform current flow density through conductive polymer 36. A generally uniform current flow density through conductive polymer 36 helps ensure a generally uniform heating thereof. In addition, when a polymer having a positive temperature coefficient is used for conductive polymer 36, its resistance increases at points of any "hot spots." This increased resistance causes current to flow to cooler points of conductive polymer 36 to further provide a generally uniform heating.

Electrodes 28 and 30 are disposed within cavity 38 so that respective fingers 46 and spokes 48 extend along conductive polymer 36 disposed between sidewall portions 50 and 51 of compartment 12. Placement of conductive polymer 36 and electrodes 28 and 30 between sidewall portions 50 and 51 as well in bottom portion 52 of cavity 38 helps ensure that at least the majority of interface 45 between body 34 and the frozen liquid is melted.

Figure 3:
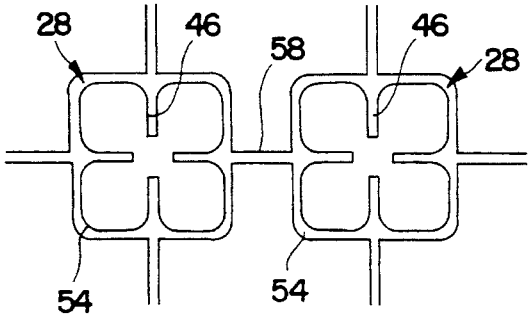
FIG. 3 shows a top view of a pair of electrodes of the present invention.

FIG. 3 shows a top view of a pair of electrodes 28 of the present invention. Electrodes 28 may be formed from stamping, printing, wireform, or equivalent method. Electrodes 28 include generally rectangular portions 54 from which fingers 46 extend inward towards a center (not shown) of generally rectangular portion 54. Electrodes 28 are interconnected together via leads 58 such that each compartment 12 has an electrode 28 disposed therein.

Figure 4:
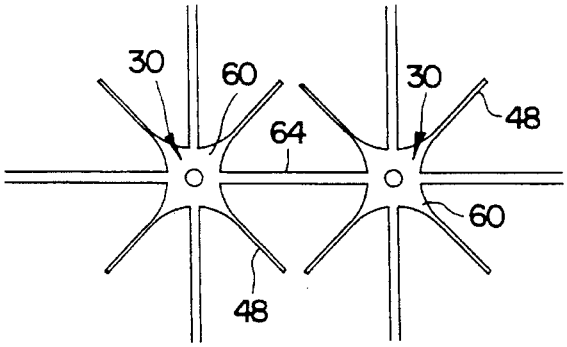
FIG. 4 shows a top view of a pair of electrodes of the present invention.

FIG. 4 shows a top view of a pair of electrodes 30 of the present invention. As with electrodes 28 of FIG. 3, electrodes 30 may be formed from stamping, printing, wireform, or equivalent method. Electrodes 30 include generally X-shaped portions 60 from which radiating spokes 48 extend. Electrodes 30 are interconnected together via leads 64 such that each compartment 12 of tray 10 has an electrode 30 disposed therein.

The geometric shapes of electrodes 28 and 30 help ensure a generally uniform current flow density through conductive polymer 36 of the present invention as discussed above. As discussed above, fingers 46 of generally rectangular portion 54 of electrode 28 and radiating spokes 48 of generally X-shaped portion 60 of electrode 30 are respectively bent downwardly and upwardly along sidewall portions 50 and 51 of each of compartments 12. This configuration facilitates generally uniform current flow density through and resultant heating of conductive polymer 36 disposed in cavities 38 of tray 10. While particular shapes for electrodes 28 and 30 are shown in FIGS. 3 and 4, it is to be understood that other geometric configurations for electrodes 28 and 30 are within the scope and spirit of the present invention.

Figure 5:
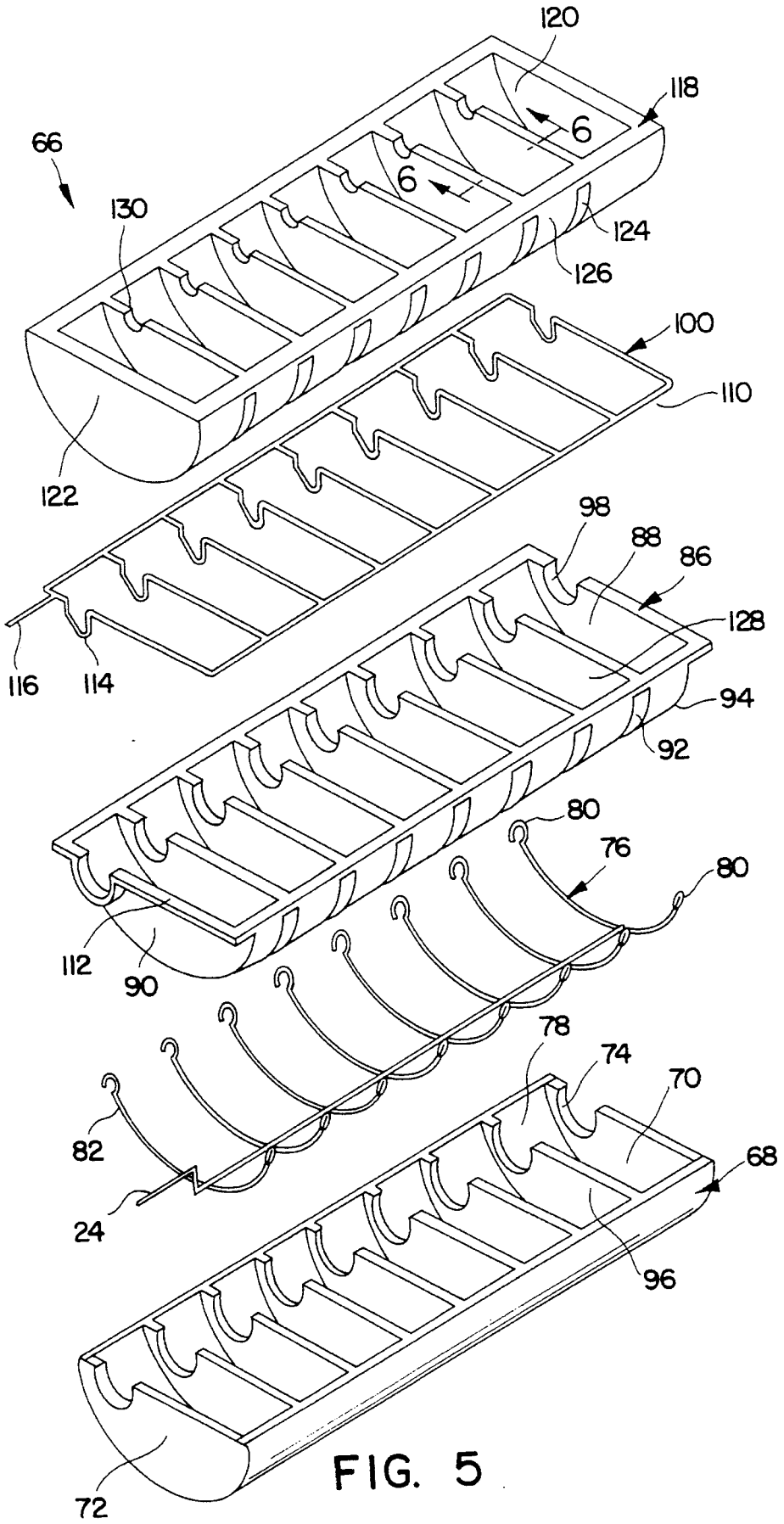
FIG. 5 shows an exploded perspective view of a rigid heated ice cube tray of the present invention.

FIG. 5 shows an exploded perspective view of a rigid heated tray 66 of the present invention. Rigid heated tray 66 includes a bottom or first tray portion 68 having a plurality of bays or compartments 70 therein. First tray portion 68 is constructed from an electrically insulative material such as a variety of polymers including polycarbonate, polyphenylene sulfide, or polyethylene sulfide. As can be seen from FIG. 5, compartments 70 have a generally crescent or semi-circular cross-sectional shape 72. Notches 74 are formed in first tray portion 68 for the provision of a liquid distribution channel similar to liquid distribution channels 14 formed in flexible heated tray 10 described above. Electrodes 76 are disposed in compartments 70 of first tray portion 68 such that bottom (not shown) and sidewall portions 78 of first tray portion 68 are adjacent electrodes 76. Electrodes 76 terminate in generally hook-shaped ends 80 and have a generally crescent or semi-circular shape 82. A terminal portion 84 is formed on electrodes 76 for interconnection with a power supply (not shown).

Intermediate or second tray portion 86 is shown as being formed such that its shape and dimensions generally conform to that of first tray portion 68. Second tray portion 86 is formed from an electrically conductive polymer. Second tray portion 86 may be made from a polymer having a positive temperature coefficient or, alternatively, from a thermoplastic. The conductive polymer may be composed of a high-density polyethylene based polymer to which carbon black is added in an amount equal to about 50% of the weight of the high-density polyethylene based polymer. Second tray portion 86 includes a plurality of bays or compartments 88 that correspond in number to those of first tray portion 68. As can be seen from FIG. 5, compartments 88 have a generally crescent or semi-circular cross-sectional shape 90. Second tray portion 86 includes a plurality of slots 92 formed in a bottom portion 94 thereof that receive wall portions 96 of first tray portion 68 when second tray portion 86 is coupled thereto. Second tray portion 86 includes a plurality of notches 98 formed therein for the provision of a liquid distribution channel as discussed above.

Electrodes 100 are shown as having a generally rectangular shape 110. As with electrodes 76, electrodes 100 are formed from an electrically conductive material. Electrodes 100 are disposed on top portions 112 of second tray portion 86. Electrodes 100 include bent portions 114 that are disposed in notches 98 of second tray portion 86. A terminal 116 is used to connect electrodes 100 with a power supply.

A top or third tray portion 118 is shown as being formed so as to generally conform to the shape and dimensions of first tray portion 68. Third tray portion 118 includes a plurality of bays or compartments 120 corresponding in number to that of compartments 70 of first tray portion 68.

As can be seen from FIG. 5, compartments 120 of third tray portion 118 have a generally crescent or semi-circular cross-sectional shape 122. The crescent or semi-circular cross-sectional shape of compartments 70, 88, and 120 allows rigid heated tray 66 to be used in an ice maker having a plurality of rotating ejector blades. Compartments of trays used in automatic ice makers that have rotating ejector blades require at least one ramped surface in the direction of the rotation of the ejector blades.

Third tray portion 118 further includes a plurality of slots 124 formed in bottom 126 thereof in which wall portions 128 of second tray portion 86 are disposed. Third tray portion 118 includes a plurality of notches 130 that form a liquid distribution channel to facilitate the uniform and even filling of liquid in compartments 120. As with first tray portion 68, third tray portion 118 is constructed from an electrically insulative material such as a variety of polymers including polycarbonate, polyphenylene sulfide, or polyethylene sulfide.

Respective first, second, and third tray portions 70, 86, and 118 can be connected together by such methods as progressive insert or injection molding. Another possible method of formation of rigid heated tray 66 would be to injection mold second tray portion 86 from a conductive polymer material. First and third tray portions 70 and 118 could also be injection molded. Respective bottom and top electrodes 76 and 100 could then be respectively disposed in compartments 70 and on top portions 112. Tray portions 70, 86, and 118 could then be connected together via heat staking or ultrasonic welding.

Figure 6:
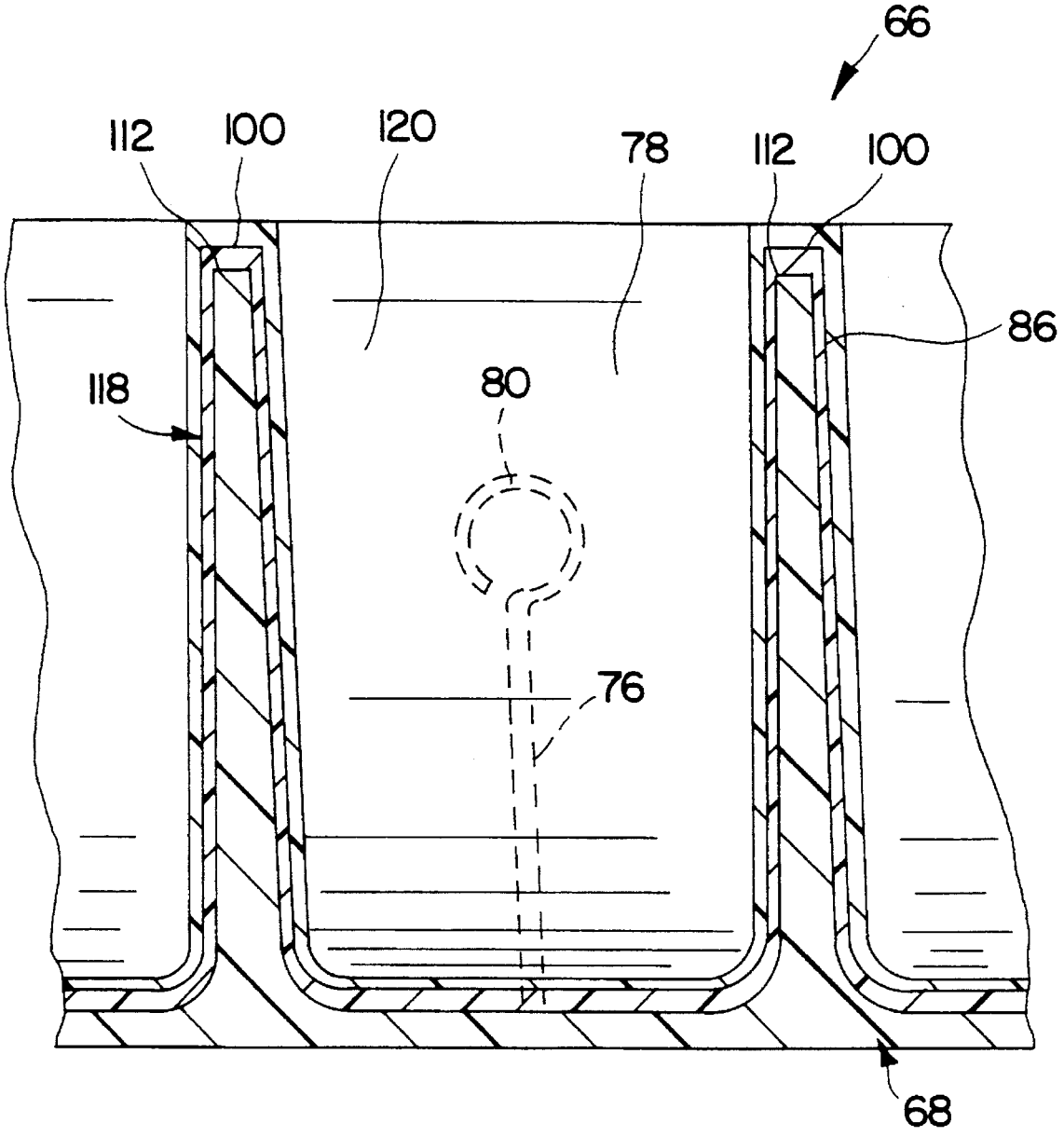
FIG. 6 shows a cross-sectional view of an assembled rigid ice cube tray taken along line 6—6 of FIG. 5.

The advantages of use of conductive polymer material discussed above in connection with heated tray 10 apply to rigid heated tray 66 of FIGS. 5 and 6. In addition, electrodes 76 and 100 can be positioned adjacent the conductive polymer of second tray portion 86 so as to ensure a generally uniform current flow density and substantially uniform heating thereof.

FIG. 6 shows a cross-sectional view through line 6—6 of FIG. 5 for an assembled rigid heated tray 66 of the present invention. As can be seen from FIG. 6, electrodes 76 and the generally hook-shaped portions 80 thereof extend well into sidewall portion 78 of compartments 70 of first tray portion 68. As discussed above, this is done in order to help provide a general uniform current flow density through the conductive polymer material from which a portion of rigid heated tray 66 is formed.

FIG. 7 is a chart of test results for a heated ice cube tray of the present invention. In this test, the ice cube tray was placed in still air at a temperature of −10° F. which was maintained throughout the test. A potential difference of 70 volts was applied to the tray and current and tray temperature were recorded at 30 second intervals. Both dissipated power and the resistance of the conductive polymer were calculated from the known voltage and current.

Figure 8:
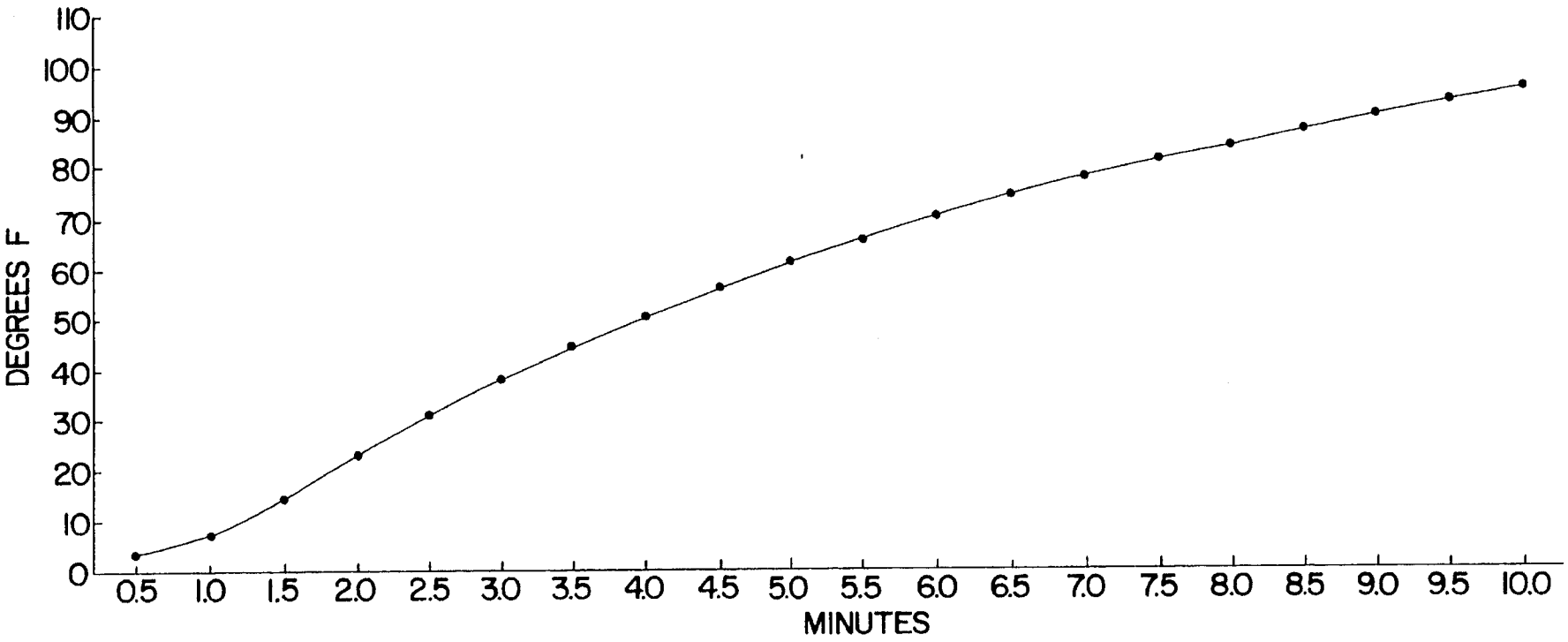
FIG. 8 is a graph of resistance versus temperature for the test results shown in FIG. 7.

FIG. 8 shows a graph of temperature versus time for the test results shown in FIG. 7. As can be seen in FIG. 8, the temperature of the tray increases with time. Initially, temperature change is larger for each incremental increase in time. However, the rate of incremental increase in temperature begins to decrease with time and eventually becomes substantially asymptotic. In one embodiment of the present invention, the conductive polymer is selected or chosen to have a maximum temperature of approximately 100 degrees Celsius.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. A heated tray which comprises:

an electrically insulative body portion having a plurality of compartments for receiving a liquid to be frozen;

an electrically conductive polymer having a resistance which changes as a function of temperature of the electrically conductive polymer, the electrically conductive polymer being configured to conform to a shape of each compartment of the electrically insulative body;

a first electrode grid; and a second electrode grid, said first electrode grid being positioned between said electrically insulative body portion and one side of said electrically conductive polymer, and having a first electrode member adjacent each compartment of the electrically insulative body portion, to facilitate a generally uniform current flow density through the electrically conductive polymer thereby helping facilitate a generally uniform heating thereof, and said second electrode grid being positioned on another side of said electrically conductive polymer and having a second electrode member adjacent each compartment of the electrically conductive polymer, to facilitate a generally uniform current flow density through the electrically conductive polymer thereby helping facilitate a generally uniform heating thereof.

2. The heated tray of claim 1, further comprising another electrically insulative body portion configured to conform to a shape of the electrically conductive polymer, said another insulative body portion being positioned adjacent said second electrode grid, so that said second electrode grid is sandwiched between said electrically conductive polymer and said another electrically insulative body.

3. The heated tray of claim 1, wherein each first electrode member has a first predetermined geometric configuration and each second electrode member has a second predetermined geometric configuration.

4. The heated tray of claim 3, wherein the first geometric configuration is different than the second geometric configuration.

5. The heated tray of claim 1, wherein each first electrode member has a generally rectangular shape and each second electrode member has a generally X-shape.

6. The heated tray of claim 1, wherein each first electrode member has a generally rectangular shape and each second electrode member has a generally crescent shape.

7. The heated tray of claim 1, wherein the resistivity of the electrically conductive polymer is selected such that a temperature of the electrically conductive polymer remains below a predetermined maximum value.

8. The heated tray of claim 1, wherein the electrically conductive polymer is selected to produce a maximum temperature of approximately 100° C.

9. The heated tray of claim 1, wherein the electrically conductive polymer is a one-piece structure.

10. The heated tray of claim 1, wherein the electrically insulative body encases the electrically conductive polymer, the first electrode grid, and the second electrode grid.

11. The heated tray of claim 1, wherein the first and second electrode grids are formed from one of a stamping, priming and wire form.

12. The heated tray of claim 1, wherein the electrically insulative body is made of a polymer.

13. The heated tray of claim 12, wherein the polymer is selected from the group consisting of polycarbonate, polyphenylene sulfide, and polyethylene sulfide.

14. The heated tray of claim 1, wherein the electrically conductive polymer comprises a polymer having a positive temperature coefficient.

15. The heated tray of claim 1, wherein the electrically conductive polymer comprises a high-density polyethylene based polymer containing up to about 50 ut. % carbon black.

16. The heated tray of claim 1, wherein the tray is constructed by progressive insert molding.

17. The heated tray of claim 1, wherein each compartment has a generally cubic shape.

18. A heated tray, comprising:

an electrically insulative body portion having a plurality of compartments for receiving a liquid to be frozen;

an electrically conductive polymer for heating each compartment of the electrically insulative body portion, the electrically conductive polymer having a resistance which changes as a function of temperature of the electrically conductive polymer;

a first electrode grid for facilitating a generally uniform current flow density through the electrically conductive polymer to help facilitate a generally uniform heating thereof, the first electrode grid being positioned adjacent a first side of the electrically conductive polymer and having a first electrode member adjacent each compartment of the electrically insulative body portion; and a second electrode grid for facilitating a generally uniform current flow density through the electrically conductive polymer to help facilitate a generally uniform heating thereof, the second electrode grid being positioned adjacent a second side of the electrically conductive polymer to form an electrically continuous circuit that includes the first electrode grid, the electrically conductive polymer, and the second electrode grid, the second electrode grid having a second electrode member adjacent each compartment of the electrically insulative body.

19. The heated tray of claim 18, wherein each first electrode member has a first predetermined geometric configuration and each second electrode member has a second predetermined geometric configuration.

20. The heated tray of claim 19, wherein the first geometric configuration is different than the second geometric configuration.

21. The heated tray of claim 18, wherein each first electrode member has a generally rectangular shape and each second electrode member has a generally X-shape.

22. The heated tray of claim 18, wherein each first electrode member has a generally rectangular shape and each second electrode member has a generally crescent shape.

23. The heated tray of claim 18, wherein the resistivity of the electrically conductive polymer is selected such that the electrically conductive polymer is prevented from being heated above a predetermined maximum value.

24. The heated tray of claim 18, wherein the electrically conductive polymer is selected to produce a maximum temperature of approximately 100° C.

25. The heated tray of claim 18, wherein the electrically conductive polymer is a one-piece structure.

26. The heated tray of claim 18, further comprising another electrically insulative body portion configured to conform to a shape of the electrically conductive polymer, said another insulative body portion being positioned adjacent said second electrode grid, so that said second electrode grid is sandwiched between said electrically conductive polymer and said another electrically insulative body.

27. The heated tray of claim 18, wherein the first and second electrode grid are formed from one of a stamping, printing or wire form.

28. The heated tray of claim 18, wherein the electrically insulative body portion is made of a polymer.

29. The heated tray of claim 28, wherein the polymer is selected from the group consisting of polycarbonate, polyphenylene sulfide, and polyethylene sulfide.

30. The heated tray of claim 18, wherein the electrically conductive polymer comprises a polymer having a positive temperature coefficient.

31. The heated tray of claim 18, wherein the electrically conductive polymer comprises a high-density polyethylene based polymer containing up to about 50 wt. % carbon black.

32. The heated tray of claim 18, wherein the tray is constructed by progressive insert molding.

33. The heated tray of claim 18, wherein each compartment has a generally cubic shape.

34. The heated tray of claim 26, wherein each of the electrically insulative body portions, and the electrically conductive polymer comprises tray portions.

* * * * *